US011435150B2

(12) United States Patent
Kinkel

(10) Patent No.: US 11,435,150 B2
(45) Date of Patent: Sep. 6, 2022

(54) PRE-EVAPORATIVE SYSTEM FOR AN EVAPORATIVE COOLING APPARATUS

(71) Applicant: Stephen Kinkel, Tempe, AZ (US)

(72) Inventor: Stephen Kinkel, Tempe, AZ (US)

(73) Assignee: United Metal Products, Inc., Tempe, AZ (US)

( * ) Notice: Subject to any disclaimer, the term of this patent is extended or adjusted under 35 U.S.C. 154(b) by 157 days.

(21) Appl. No.: 17/092,585

(22) Filed: Nov. 9, 2020

(65) Prior Publication Data

US 2021/0140728 A1 May 13, 2021

Related U.S. Application Data

(60) Provisional application No. 62/934,652, filed on Nov. 13, 2019.

(51) Int. Cl.
*F28B 1/00* (2006.01)
*F28F 25/08* (2006.01)
*F28C 1/14* (2006.01)

(52) U.S. Cl.
CPC ..... *F28F 25/087* (2013.01); *F28C 1/14* (2013.01)

(58) Field of Classification Search
CPC ..... F28F 25/085; F28F 25/087; F28F 25/08; F28C 1/14
USPC ..... 165/110
See application file for complete search history.

(56) References Cited

U.S. PATENT DOCUMENTS

| | | | | |
|---|---|---|---|---|
| 275,869 | A * | 4/1883 | Stockman | F28C 1/14 261/161 |
| 5,540,867 | A * | 7/1996 | DeBello | F28F 25/087 55/491 |
| 8,534,039 | B1 * | 9/2013 | Pierson | F01K 25/106 60/39.182 |
| 8,579,074 | B2 * | 11/2013 | Kosaka | F02C 7/045 181/224 |
| 8,839,847 | B2 * | 9/2014 | Suzuki | F25B 39/04 165/110 |
| 8,950,213 | B2 * | 2/2015 | Mitsuhashi | F25B 39/04 165/110 |
| 9,359,914 | B2 * | 6/2016 | Zhang | F02C 7/045 |
| 10,260,421 | B2 * | 4/2019 | Frese | F04D 29/5826 |
| 2007/0151278 | A1 * | 7/2007 | Jarvis | F24F 1/0007 62/310 |
| 2018/0094884 | A1 * | 4/2018 | Rousselet | F28C 1/00 |

* cited by examiner

*Primary Examiner* — Claire E Rojohn, III
(74) *Attorney, Agent, or Firm* — Schmeiser, Olsen & Watts LLP

(57) ABSTRACT

A pre-evaporative system used with an evaporative cooling apparatus is provided. The system may include a pre-evaporative media and a cooling media, each having a fiber pad with an edge coating and a distribution plate. The distribution plate operates to evenly distribute water over the entire surface. The system includes a shield with a mounting plate. The shield with the mounting plate operate to retain the pre-evaporative media and the cooling media adjacent each other; to form a seal with the distribution plate of the pre-evaporative media and with the distribution plate of the cooling media; and to shield a first water distribution pipe and a second water distribution pipe that supply water to the pre-evaporative media and the cooling media.

9 Claims, 5 Drawing Sheets

PRE-EVAPORATIVE SYSTEM FOR AN EVAPORATIVE COOLING APPARATUS

CROSS REFERENCE TO RELATED APPLICATION[S]

This application is a claims priority to U.S. Provisional Patent Application Ser. No. 62/934,652, filed Nov. 13, 2019, the disclosure of which is hereby incorporated entirely herein by reference.

BACKGROUND OF THE INVENTION

Technical Field

This invention relates generally to an evaporative cooling system, and more specifically, to a pre-evaporative system for use with an evaporative cooling apparatus that utilizes fresh water to control a buildup of mineral deposits in the apparatus.

State of the Art

Evaporative coolers are used in a variety of settings including factories, warehouses, workshops, and agricultural structures, as well as in homes and offices. Evaporative coolers are an attractive alternative to conventional air conditioning and mechanical refrigeration systems because they require minimal parts, are relatively simple to manufacture and maintain, are inexpensive to operate, and do not use ozone damaging refrigerants.

Generally, an evaporative cooling apparatus includes a large fan and water-wetted pads, also known as cooling media, mounted perpendicular to an outside air stream. Water is drawn from a sump and distributed over the top of the cooling media where the water flows down through the cooling media back to the sump. The cooling media absorbs some of this water producing a water field in the path of the outside air stream. The fan draws the outside air through the cooling media, which cools the air through the evaporation of the water in the cooling media and blows the cooled air into the house. The evaporative cooler also slightly increases the humidity of the entering air. The cooling media on an evaporative cooler is a fairly efficient air filter, trapping particles on the wet surface. A continuous wetting of the cooling media flushes the trapped particles into the sump, or reservoir, below the cooling media.

Evaporative coolers rely on the efficiency of the cooling media to obtain maximum performance. Unfortunately, minerals supplied in the water will concentrate in the sump and eventually begin to create mineral deposits, also known as scale on the cooling media. The scale buildup in the sump can also undesirably affect the wet components, such as the recirculation pump. Thus, these deposits can severely degrade the efficiency of the cooling media and other wet components, shorten their useful life, and increase the cost of maintaining the evaporative cooler. In addition, scale can trap biological organisms and other organic materials that produce odors, provide a medium for the growth of bacteria and molds, and cause other negative effects.

A technique sometimes used to manage scale in an evaporative cooler is to periodically use acid treatments to dissolve the scale. Although acid will dissolve some of the scale, the acid has the undesirable effect of increasing corrosion in the evaporative cooler. Another technique is to frequently replace the cooling pads and physically scrape and remove scale from the cooler. This can become expensive and quite time consuming. As such, neither of these techniques is considered acceptable.

Some evaporative coolers are manufactured with a bleed-off system that continuously leaks a small quantity of water from the water distribution system in order to dilute mineral concentrations in the water in the sump. Unfortunately, even with the use of a bleed-off system, scale still forms at the point of greatest evaporation, that is, on the cooling media. Other evaporative coolers come with a sump dump, or blow-down system, that periodically dumps the water from the sump while the cooler is being operated. A blow-down system is useful in dusty areas, because it cleans the sump of filtered dirt and particles. Unfortunately, like the bleed-off systems, scale still forms at the point of greatest evaporation, that is, on the cooling media.

The problem of scale buildup is exacerbated in evaporative coolers used for cooling large industrial settings, such as warehouses, factories, agricultural structures, and so forth. These industrial evaporative coolers typically deliver an air volume of 10,000 cubic feet per minute (CFM) or higher, drawn through cooling media that may be eight to thirty-six inches thick. This is in contrast to residential evaporative coolers that typically deliver an air volume of 3300 CFM, 4500 CFM, or 6500 CFM, drawn through cooling media that is less than eight inches thick.

The greater cooling requirements of industrial evaporative coolers cause industrial coolers to evaporate significantly more water than their residential counterparts. As such, scale buildup on the cooling media is greatly increased. Unfortunately, component replacement and labor costs associated with repairing an industrial evaporative cooler are much greater than that of residential coolers. The costs are much higher due to the large housing size, the large cooling media, the high air draw fans, and the high water volume recirculation pumps needed to produce cooled air at air volumes in excess of 10,000 CFM.

Existing solutions to this problem are still have drawbacks that include a high cost of replacement, replacement of loaded filtering media, distribution of water over the surface and space consumption to name a few.

Accordingly, there is a need for an improved system that utilizes a pre-evaporative system.

SUMMARY OF THE INVENTION

The present invention relates to a pre-evaporative system for use with an evaporative cooling apparatus that utilizes fresh water to control a buildup of mineral deposits in the apparatus.

An embodiment includes a pre-evaporative system used with an evaporative cooling apparatus, the system comprising: a pre-evaporative media comprising a fiber pad with an edge coating with a first distribution plate coupled to the pre-evaporative media; a cooling media comprising a fiber pad with an edge coating with a second distribution plate coupled to the cooling media; a shield removably coupled to a mounting plate, wherein the shield retains the pre-evaporative media and the cooling media adjacent each other and between the shield and the mounting plate when the shield is coupled to the mounting plate; a seal formed between the first distribution plate and the shield when the shield is coupled to the mounting plate; a seal formed between the second distribution plate and the shield when the shield is coupled to the mounting plate; and a first water distribution pipe and a second water distribution pipe extending between the shield and the first distribution plate and the second distribution plate, thereby shielding the first and second water distribution pipes when the shield is coupled to the mounting plate.

Another embodiment includes a method of using a pre-evaporative system used with an evaporative cooling apparatus, the method comprising: retaining a pre-evaporative media and a cooling media of the system adjacent each other and between a shield and a mounting plate in response to removably coupling the shield to the mounting plate; forming a seal between the first distribution plate and the shield in response to removably coupling the shield to the mounting plate; forming a seal between the second distribution plate and the shield in response to removably coupling the shield to the mounting plate; and shielding a first water distribution pipe and a second water distribution pipe extending between the shield and the first distribution plate and the second distribution plate in response to removably coupling the shield to the mounting plate.

Yet another embodiment includes a pre-evaporative system used with an evaporative cooling apparatus, the system comprising: a pre-evaporative media comprising a fiber pad with an edge coating and a first distribution plate built-in to the pre-evaporative media; a cooling media comprising a fiber pad with an edge coating and a second distribution plate built-in to the cooling media; a shield removably coupled to a mounting plate, wherein the shield retains the pre-evaporative media and the cooling media adjacent each other and between the shield and the mounting plate when the shield is coupled to the mounting plate; a seal formed between the first distribution plate and the shield when the shield is coupled to the mounting plate; a seal formed between the second distribution plate and the shield when the shield is coupled to the mounting plate; a first water distribution pipe and a second water distribution pipe extending between the shield and the first distribution plate and the second distribution plate, thereby shielding the first and second water distribution pipes when the shield is coupled to the mounting plate; and a removal tool for removing the pre-evaporative media and the cooling media.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
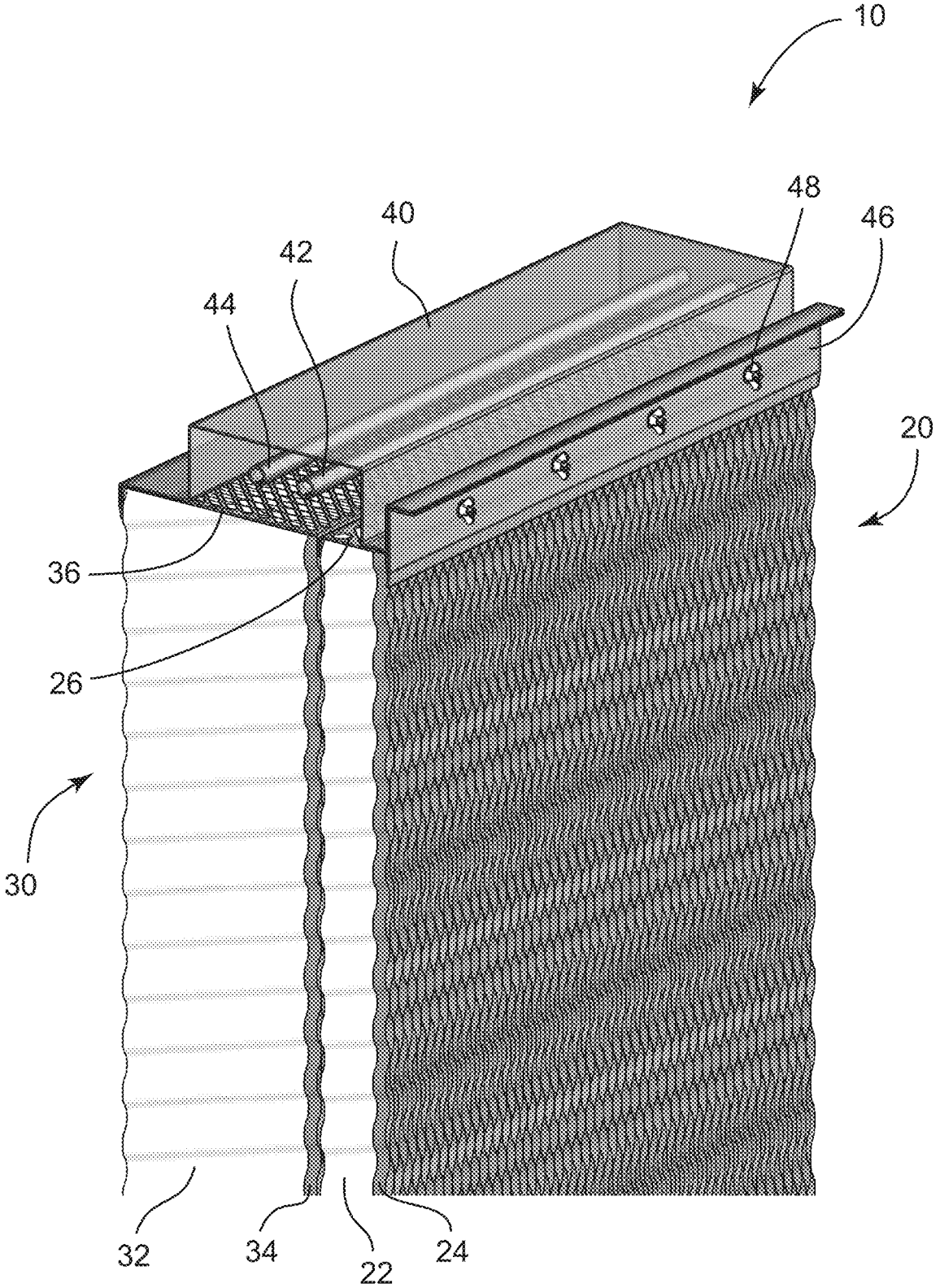
FIG. 1 is a perspective view of a pre-evaporative system used with an evaporative cooling apparatus, according to an embodiment.
Figure 2:
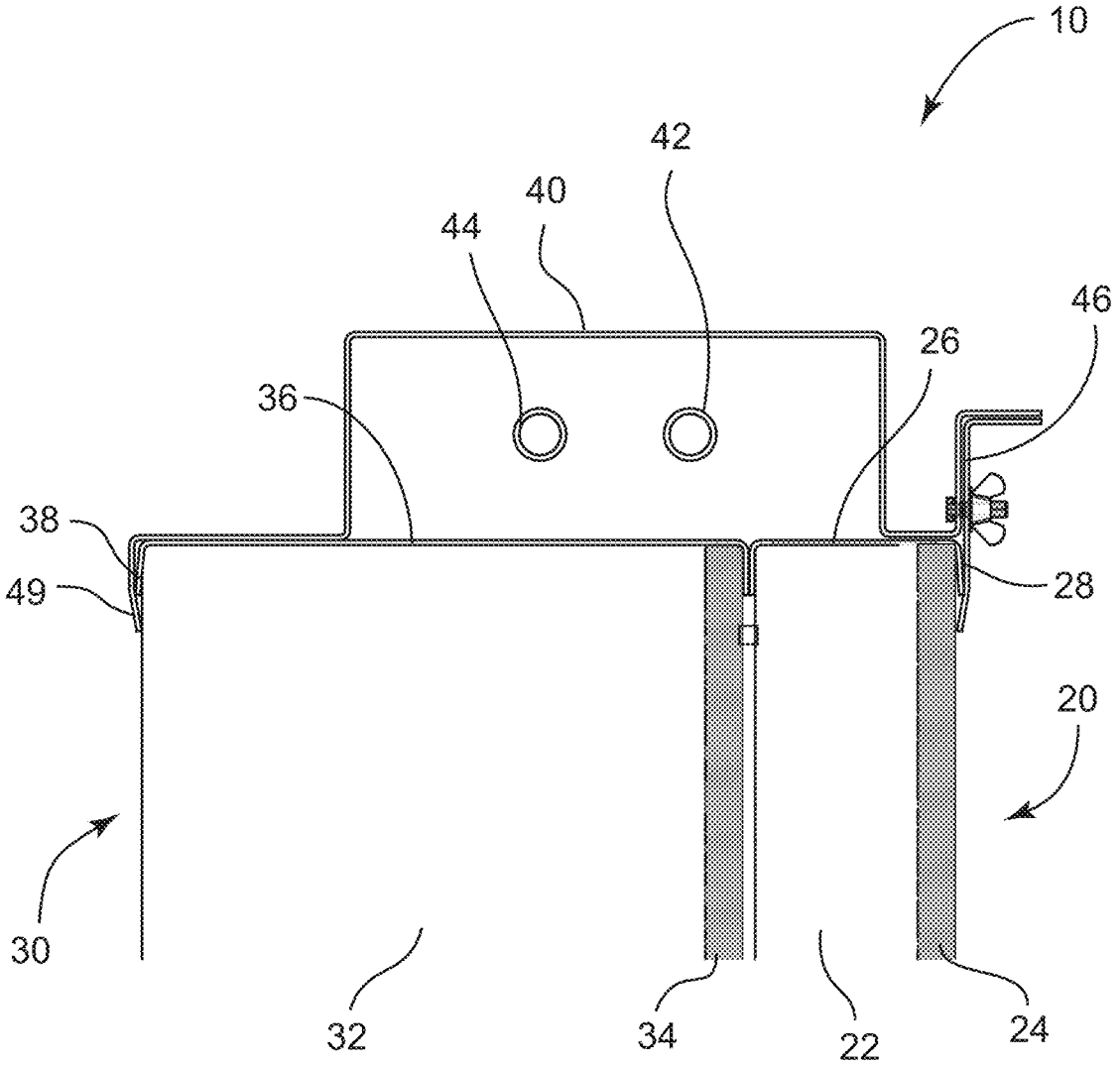
FIG. 2 is a side view of a pre-evaporative system used with an evaporative cooling apparatus, according to an embodiment.

As discussed above, embodiments of the present invention relate to a pre-evaporative system for use with an evaporative cooling apparatus that utilizes fresh water to control a buildup of mineral deposits in the apparatus. A description of an evaporative cooling apparatus that utilizes fresh water to control a buildup of mineral deposits in the apparatus can be found in U.S. Pat. No. 6,367,277, the disclosure of which is incorporated entirely herein by reference. The pre-evaporative system enhances the function of the evaporative cooling apparatus shown in U.S. Pat. No. 6,367,277, which is incorporated entirely herein by reference.

As shown in FIGS. 1-4, a pre-evaporative system 10 may include a pre-evaporative media 20, a cooling media 30, and a shield 40 with a mounting plate 46. The pre-evaporative media 20 may include a cellulose fiber or synthetic fiber pad 22 with an edge coating 24 and further may include a first distribution plate 26 coupled to the pre-evaporative media 20. The cooling media 30 may include a cellulose fiber or synthetic fiber pad 32 with an edge coating 34 and further may include a second distribution plate 36 coupled to the cooling media 30. The shield 40 with mounting plate 46 operates to retain the pre-evaporative media 20 and the cooling media 30 in a position adjacent one another. The shield 40 also forms a seal with the respective first and second distribution plates 26 and 36. The shield 40 provides these function above, while also shielding a first and second water distribution pipes 42 and 44 respectively. For example, and without limitation, an edge 28 of distribution plate 20 extends at an angle, such as an 80 degree angle, and an edge 38 of distribution plate 30 extend at an angle, such as an 80 degree angle. (See FIG. 2) The shield 40 has an edge 49 that engages the angled edge 38 of the distribution plate 30 and the mounting plate 46 is coupled to the shield 40 on a side opposite the edge 49 with couplers 48 and engages the angled edge 28 of the distribution plate 20, thereby forming a seal along the distribution plates of the pre-evaporative media 20 and the cooling media 30 to divert all water to the pre-evaporative media 20 and the cooling media 30. (See FIG. 2) This configuration of components allows for a smaller air tunnel height saving space and cost.

By splitting the media of an evaporative cooling apparatus into a pre-evaporative media 20 and a cooling media 30, cost for replacement may be reduced by ⅔. Further, having a pre-evaporative media 20 and a cooling media 30 allows for much higher cycles of concentration and less water consumed in flush down.

Figure 3:
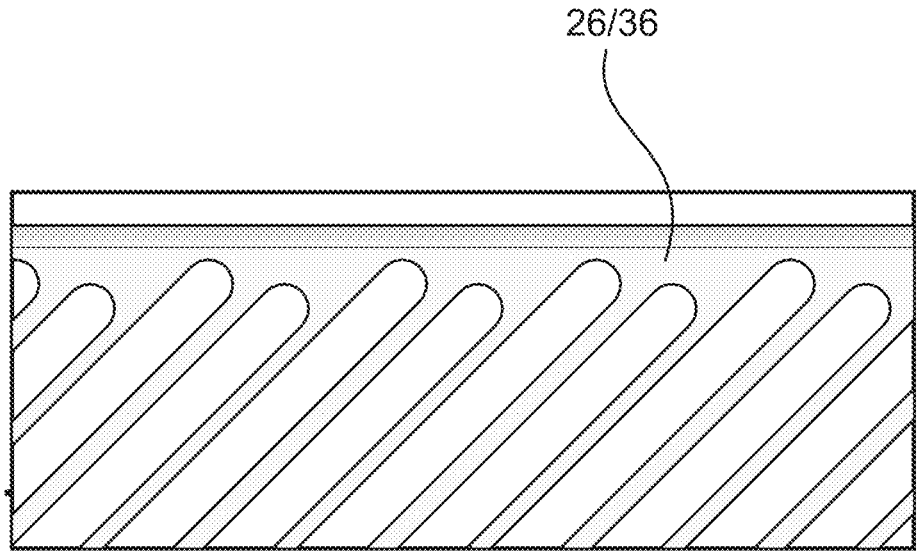
FIG. 3 is a close-up view of a distribution plate of media of an evaporative cooling apparatus, according to an embodiment.

As shown in FIGS. 1 and 3, the first distribution plate 26 coupled to the pre-evaporative media 20 may be a built-in distribution plate that diverts water evenly over the entire surface of the pre-evaporative media 20 and the second distribution plate 36 coupled to the cooling media 30 may be a built-in distribution plate that diverts water evenly over the entire surface of the cooling media 30. The operation of first and second distribution plates 26 and 36 eliminate the need for a distributer section of the evaporative cooling apparatus.

Figure 4:
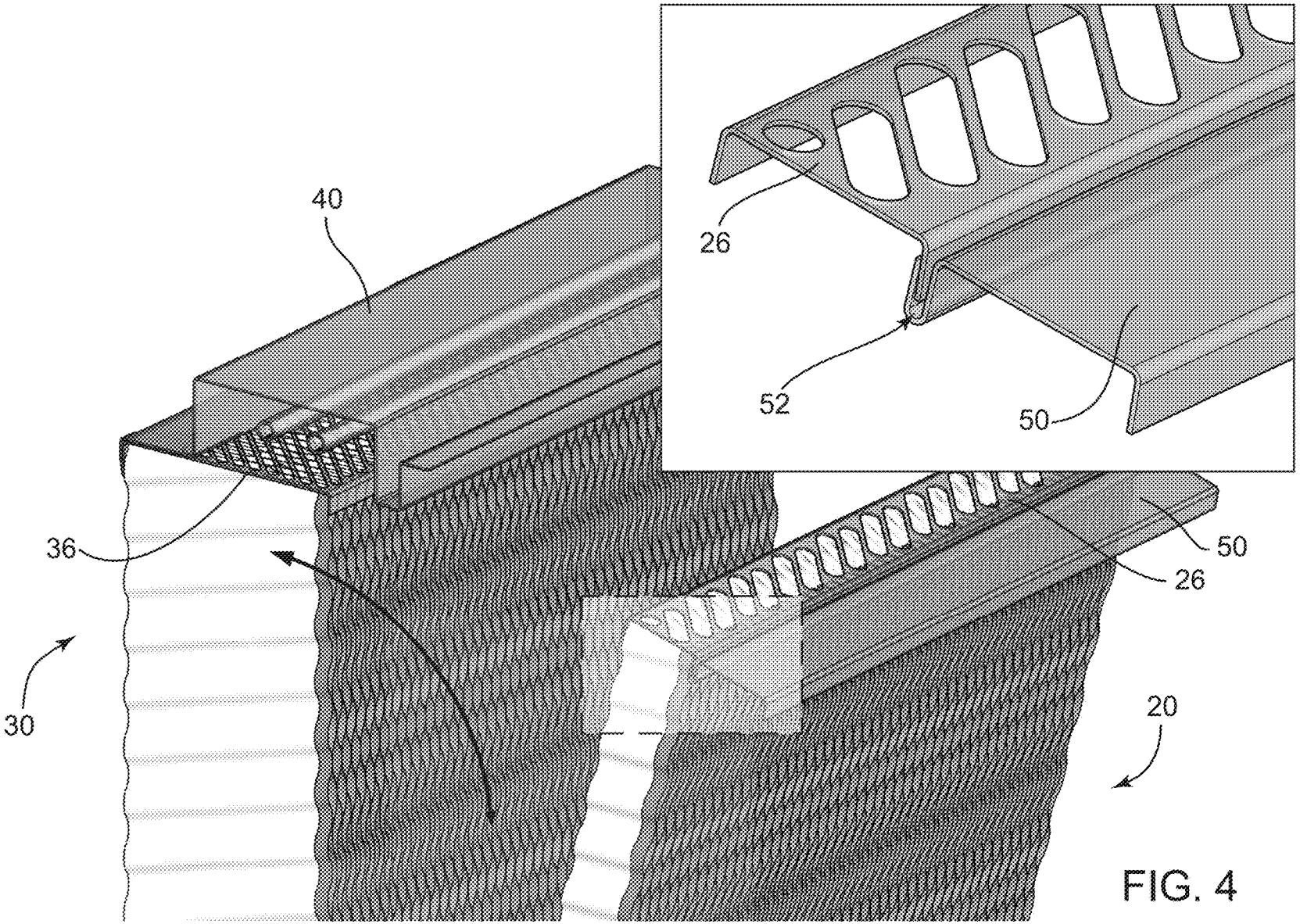
FIG. 4 is a perspective view of a pre-evaporative system being removed from an evaporative cooling apparatus, according to an embodiment.

Referring to FIG. 4, the first and second distribution plates 26 and 36 also operates to engage a removal tool 50 of the pre-evaporative system 10. The mounting plate 48 may be uninstalled from the shield 40, exposing the first distribution plate 26 coupled to the pre-evaporative media 20. The removal tool 50 may include a channel 52 that can engage the edge 28 of the first distribution plate 26 such that the edge 28 is inserted within the channel 52. The removal tool 50 may be pulled and the force applied to the tool pulls the pre-evaporative media 20 away from the cooling media and the shield 40 to be removed. In a similar manner, the cooling media 30 may be removed. The removal tool 50 in combination with the other unique elements of the pre-evaporative media 20, the cooling media 30 and the shield 40 with mounting plate 48 provide a unique pad removal system allowing the quick and efficient replacement of the loaded media 20 and 30.

Figure 5:
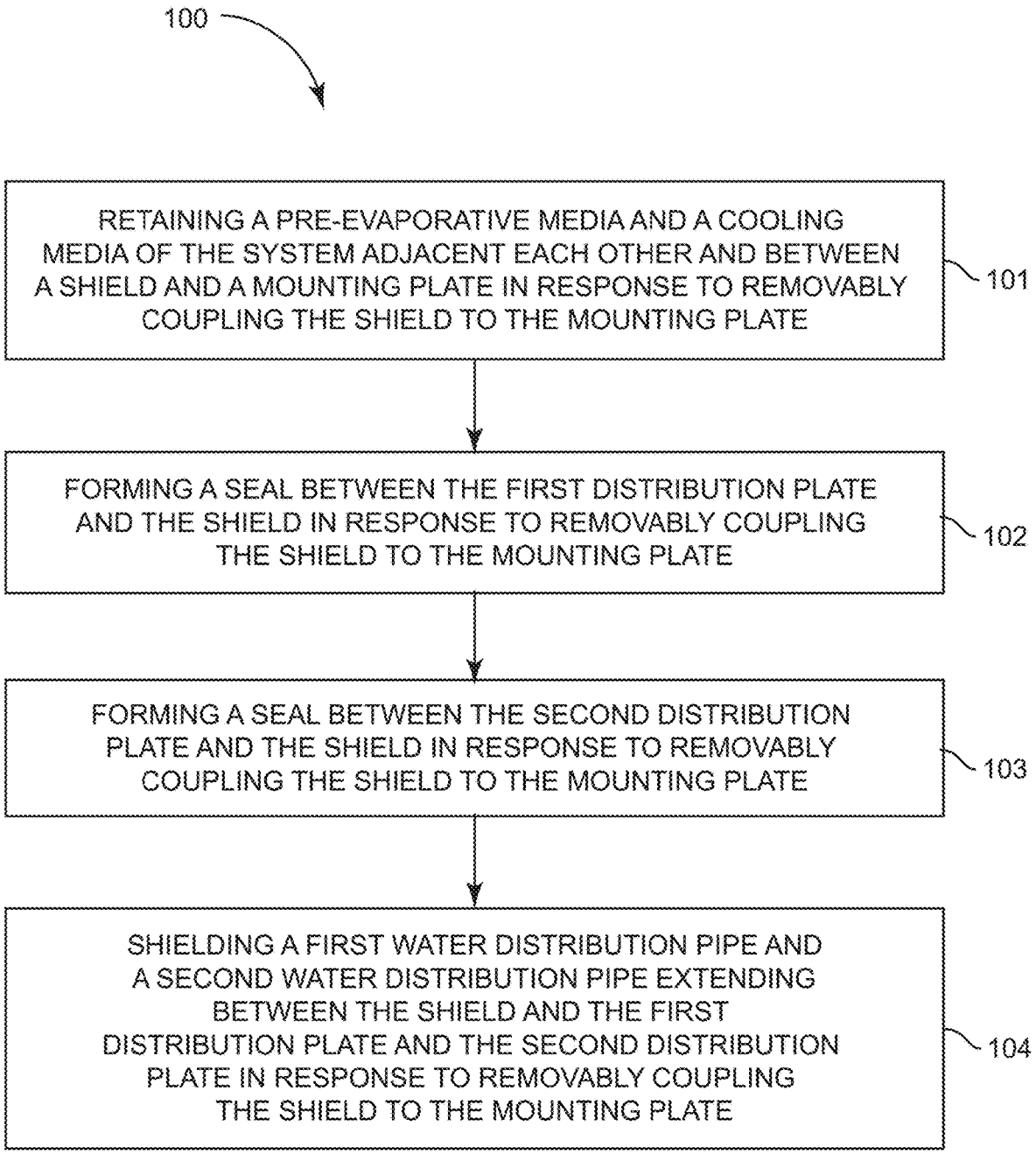
FIG. 5 is a flow chart depicting a method of using a pre-evaporative system, according to an embodiment.

Referring to FIG. 5, depicted is a method 100 of using a pre-evaporative system used with an evaporative cooling apparatus. The method 100 comprises retaining a pre-evaporative media and a cooling media of the system adjacent each other and between a shield and a mounting plate in response to removably coupling the shield to the mounting plate (Step 101); forming a seal between the first distribution plate and the shield in response to removably coupling the shield to the mounting plate (Step 102); forming a seal between the second distribution plate and the shield in response to removably coupling the shield to the mounting plate (Step 103); and shielding a first water distribution pipe and a second water distribution pipe extending between the shield and the first distribution plate and the second distribution plate in response to removably coupling the shield to the mounting plate (Step 104).

The method may also comprise uncoupling the shield and the mounting plate; engaging a removal tool with one of an edge of the first distribution plate or an edge of the second distribution plate; applying a force to the removal tool away from the pre-evaporative media or the cooling media to apply a force to the first distribution plate or the second distribution plate respectively; and removing the pre-evaporative media or the cooling media from the shield in response to applying the force to the removal tool.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A pre-evaporative system used with an evaporative cooling apparatus, the system comprising:
- a pre-evaporative media comprising a fiber pad with an edge coating with a first distribution plate coupled to the pre-evaporative media;
- a cooling media comprising a fiber pad with an edge coating with a second distribution plate coupled to the cooling media;
- a shield removably coupled to a mounting plate, wherein the shield retains the pre-evaporative media and the cooling media adjacent each other and between the shield and the mounting plate when the shield is coupled to the mounting plate;
- a seal formed between the first distribution plate and the shield when the shield is coupled to the mounting plate;
- a seal formed between the second distribution plate and the shield when the shield is coupled to the mounting plate; and
- a first water distribution pipe and a second water distribution pipe extending between the shield and the first distribution plate and the second distribution plate, thereby shielding the first and second water distribution pipes when the shield is coupled to the mounting plate.

2. The system of claim 1, where in the first distribution plate is built-in to the pre-evaporative media.

3. The system of claim 1, where in the second distribution plate is built-in to the cooling media.

4. The system of claim 1, further comprising a removal tool for removing the pre-evaporative media and the cooling media.

5. The system of claim 1, wherein the removal tool comprises a channel that engages an edge of the first distribution plate or an edge of the second distribution plate.

6. The system of claim 5, wherein force applied to the removal tool away from the pre-evaporative media or the cooling media applies a force to the first distribution plate or the second distribution plate respectively to remove the pre-evaporative media or the cooling media from the shield.

7. A pre-evaporative system used with an evaporative cooling apparatus, the system comprising:
- a pre-evaporative media comprising a fiber pad with an edge coating and a first distribution plate built-in to the pre-evaporative media;
- a cooling media comprising a fiber pad with an edge coating and a second distribution plate built-in to the cooling media;
- a shield removably coupled to a mounting plate, wherein the shield retains the pre-evaporative media and the cooling media adjacent each other and between the shield and the mounting plate when the shield is coupled to the mounting plate;
- a seal formed between the first distribution plate and the shield when the shield is coupled to the mounting plate;
- a seal formed between the second distribution plate and the shield when the shield is coupled to the mounting plate;
- a first water distribution pipe and a second water distribution pipe extending between the shield and the first distribution plate and the second distribution plate, thereby shielding the first and second water distribution pipes when the shield is coupled to the mounting plate; and
- a removal tool for removing the pre-evaporative media and the cooling media.

8. The system of claim 7, wherein the removal tool comprises a channel that engages an edge of the first distribution plate or an edge of the second distribution plate.

9. The system of claim 7, wherein force applied to the removal tool away from the pre-evaporative media or the cooling media applies a force to the first distribution plate or the second distribution plate respectively to remove the pre-evaporative media or the cooling media from the shield.

* * * * *